US007938135B2

(12) United States Patent
Desfosses et al.

(10) Patent No.: US 7,938,135 B2
(45) Date of Patent: May 10, 2011

(54) TENT HAVING WIND RESISTANT FRAME

(76) Inventors: Rene Claude Desfosses, Airdrie (CA); Helene C Desfosses, Peace River (CA)

( * ) Notice: Subject to any disclaimer, the term of this patent is extended or adjusted under 35 U.S.C. 154(b) by 0 days.

(21) Appl. No.: 12/455,051

(22) Filed: May 29, 2009

(65) Prior Publication Data

US 2010/0300502 A1 Dec. 2, 2010

(51) Int. Cl.
*E04H 15/48* (2006.01)

(52) U.S. Cl. ..... 135/135; 135/119; 135/156; 135/147; 160/384

(58) Field of Classification Search ..... 135/98, 135/133, 135, 144, 147, 152–153, 159, 123, 135/905; 52/82, 83, 641, 645–646; 160/380, 160/382–384
See application file for complete search history.

(56) References Cited

U.S. PATENT DOCUMENTS

| | | | | | |
|---|---|---|---|---|---|
| 136,456 | A * | 3/1873 | Petersen et al. | 135/139 |
| 1,413,529 | A * | 4/1922 | Hansen | 135/159 |
| 1,631,215 | A * | 6/1927 | Leffert | 135/98 |
| 1,735,737 | A * | 11/1929 | Dial | 135/147 |
| 1,853,367 | A * | 4/1932 | Mace | 135/123 |
| 2,185,629 | A * | 1/1940 | Dixon | 135/153 |
| 2,521,042 | A * | 9/1950 | Louis | 135/147 |
| 2,547,770 | A * | 4/1951 | Pelton | 135/126 |
| 2,685,885 | A * | 8/1954 | West | 135/20.3 |
| 3,169,543 | A * | 2/1965 | McGerty | 135/152 |
| 5,335,685 | A * | 8/1994 | Dahulich | 135/156 |
| 5,797,695 | A * | 8/1998 | Prusmack | 403/170 |
| 6,776,179 | B1 * | 8/2004 | Chen | 135/147 |
| 7,140,377 | B1 * | 11/2006 | Dahulich | 135/136 |
| 7,341,071 | B2 * | 3/2008 | Lee | 135/128 |
| 7,597,111 | B2 * | 10/2009 | Bauer | 135/96 |
| 2007/0215192 | A1 * | 9/2007 | Hoffman | 135/135 |

FOREIGN PATENT DOCUMENTS

| | | | |
|---|---|---|---|
| GB | 2259927 A | * | 3/1993 |
| GB | 2273723 A | * | 6/1994 |
| GB | 2321656 A | * | 8/1998 |

* cited by examiner

*Primary Examiner* — Winnie Yip
(74) *Attorney, Agent, or Firm* — G. F. Gallinger

(57) ABSTRACT

A tent having a wind resistant tubular frame comprises: a frame having a) multiple frame legs, each leg having a lower portion lockingly hinged to an upper portion, wherein the lower portion can be swung open from a storage position in which the upper and lower portions are adjacent to each other, and then locked in an open operable position; and, b) a crown to which the an inner end portion of the upper portion of each one of the multiple legs is hinged generally laterally thereto, wherein the legs can be laterally rotated from a storage position in which they are adjacent to each other to an operable, spaced apart position in which the frame legs radiate outwardly from the crown; and, a canvas, shaped to cover one of an inner and outer sides of the frame. In a preferred aspect of this invention the tent further comprises a door side leg for opening an entire segment of the tent between two tent frame legs for convenient entry of large equipment. The door side leg is rotably positioned between two spaced apart frame legs and can be rotated between an open position and a closed position adjacent to a leg on one side of the door. Canvas attached to the door side leg is pulled and held in a closed position when the leg is rotated to the closed position.

13 Claims, 4 Drawing Sheets

TENT HAVING WIND RESISTANT FRAME

FIELD OF THE INVENTION

This invention relates to tents having sustained durability and stability in high winds. More particularly this invention relates to a tent having a collapsible tent frame which has particular application in construction projects.

BACKGROUND OF THE INVENTION

The inventor herein supervises the erection and welding of steel in construction projects in the Province of Alberta in Canada. Temporary shelters must be erected for pipe fitters and welders. The shelters which are currently in use generally either are heavy and lack portability, or alternatively, they lack stability in high winds. There is an unsatisfied need for a portable structure which is conveniently and quickly able to be erected, and which additionally, is stable in high winds, and thermally protective, both in cold and hot locations.

This disclosed tent additionally has applicability mobilization and demobilization in military applications. Erection of this rugged shelter is fast and the canvas may be camouflaged. Hunters similarly have need of a rugged shelter having a strong frame which can carry a spaced double layer of canvas, and even an insulating inner layer. The tent normally comprises a greenhouse weight of polyethylene. The tent would make a durable greenhouse.

OBJECTS OF THE INVENTION

It is an object of this invention to disclose an exceptionally rugged tent. A tent which can withstand strong winds over multiple seasons. The tent which has a substantial rugged frame which can provide thermal protection by carrying a heavy spaced canvases on its inner and outer side. It is also an object of this invention to disclose a tent which has an entry door for large material and equipment.

One aspect of this invention provides for a tent comprising: a frame having a) multiple frame legs, each leg having a lower portion lockingly hinged to an upper portion, wherein the lower portion can be swung open from a storage position in which the upper and lower portions are adjacent to each other, and then locked in an open operable position; and, b) a crown to which the an inner end portion of the upper portion of each one of the multiple legs is hinged generally laterally thereto, wherein the legs can be laterally rotated from a storage position in which they are adjacent to each other to an operable, spaced apart position in which the frame legs radiate outwardly from the crown; and, a canvas, shaped to cover of an inner or outer side of the frame.

In a preferred aspect of this invention the above tent further comprises a door side leg for opening an entire segment of the tent between two tent frame legs for convenient entry of large equipment, said door side leg rotably positioned between two spaced apart frame legs. The door side leg can be rotated between an open position and a closed position adjacent to a leg on one side of the door. Canvas attached to the door side leg is pulled and held in a closed position when the leg is rotated to the closed position.

Various other objects, advantages and features of this invention will become apparent to those skilled in the art from the following description in conjunction with the accompanying drawings.

FIGURES OF THE INVENTION

FIG. 2B shows the canvas clamped between the C shaped channel portion of the frame leg and the zig-zagged wire positioned within the C shaped channel.

Figure 1:
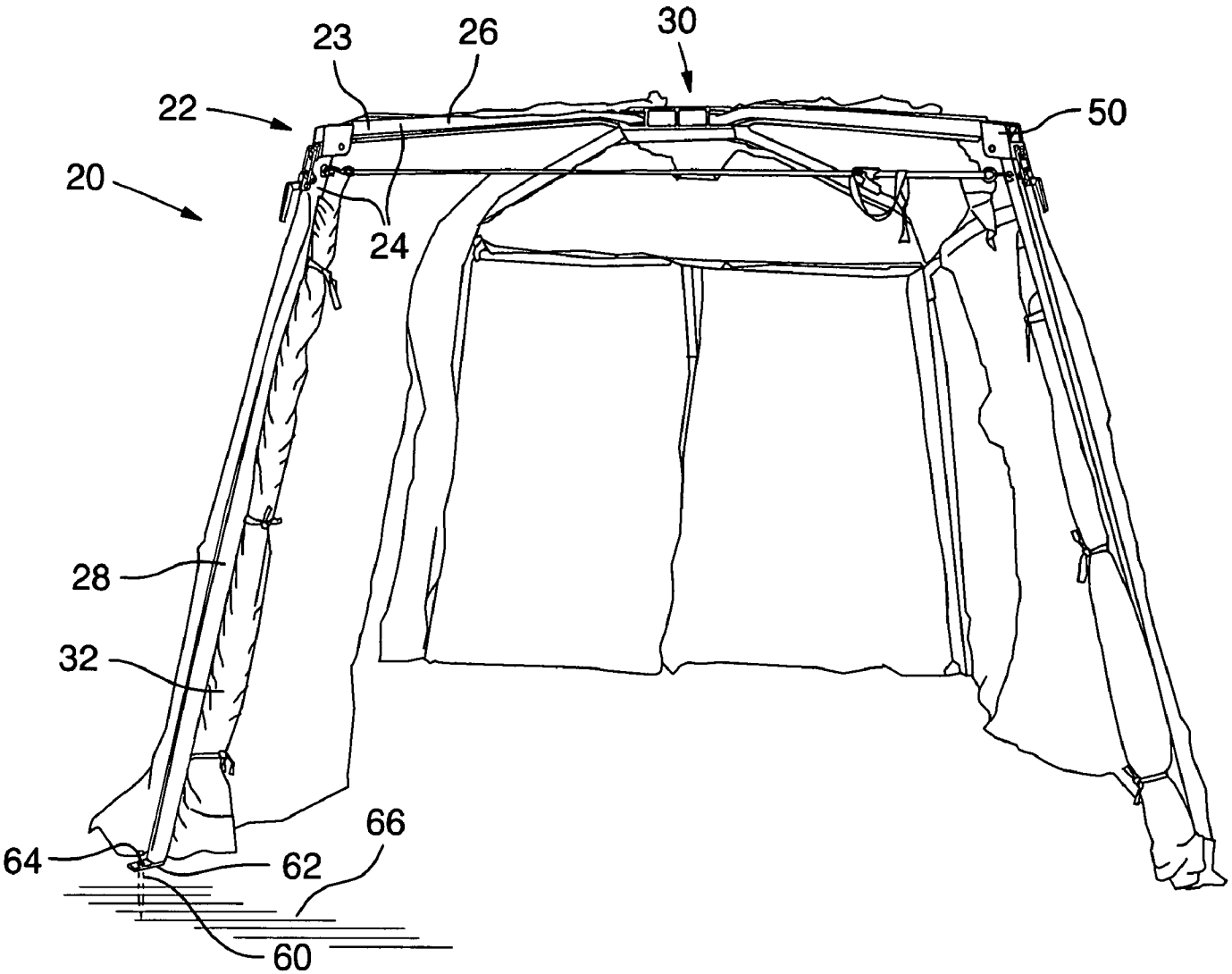
FIG. 1 is a perspective view of a tent having a wind resistant tubular frame.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a tent 20 having a wind resistant tubular frame 22. Most generally the tent 20 comprises: a frame 22 having a) multiple frame legs 24, each leg 24 having a lower portion 28 lockingly hinged to an upper portion 26, wherein the lower portion 28 can be swung open from a storage position in which the upper portion 26 and lower portion 28 are adjacent to each other, and then locked in an open operable position; and, b) a crown 30 to which the an inner end portion of the upper portion 26 of each one of the multiple legs 24 is hinged generally laterally thereto, wherein the legs 24 can be laterally rotated from a storage position in which they are adjacent to each other to an operable, spaced apart position in which the frame legs 24 radiate outwardly from the crown 30; and, a canvas 32, shaped to cover one of an inner and outer sides of the frame 22.

Figure 2:
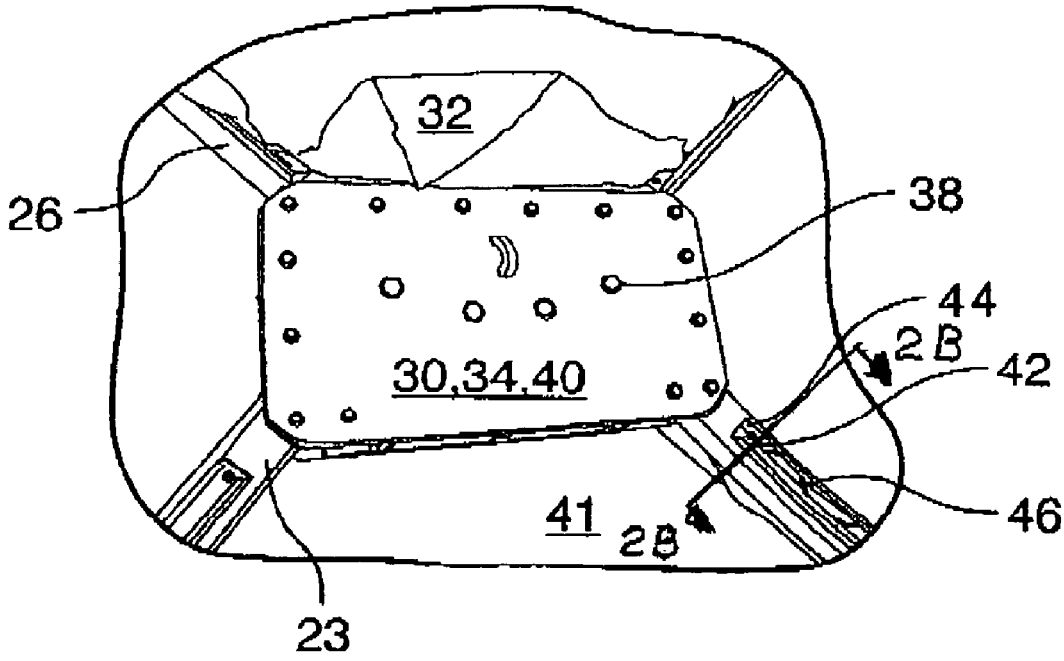
FIG. 2 is a partial perspective view taken from inside the tent shown in FIG. 1, looking up at the crown, which is used to hingably attach an upper portion of each one of the multiple legs.

FIG. 2 is a partial perspective view taken from inside the tent 20 shown in FIG. 1, looking up at the crown 30, which is used to hingably attach an upper portion 26 of each one of the multiple legs 24. The crown 30 most preferably comprises two spaced apart parallel members 34 and the lateral hinges 36 comprises bolts 38 extending between the parallel members 34 and through an inner end portion of each of the frame legs 24. Most preferably the two spaced apart parallel members 34 comprise planar members 40 attached together by spacers 41 and wherein the hinge bolts 38 are spaced along a central portion of the planar members 40.

Figure 2B:
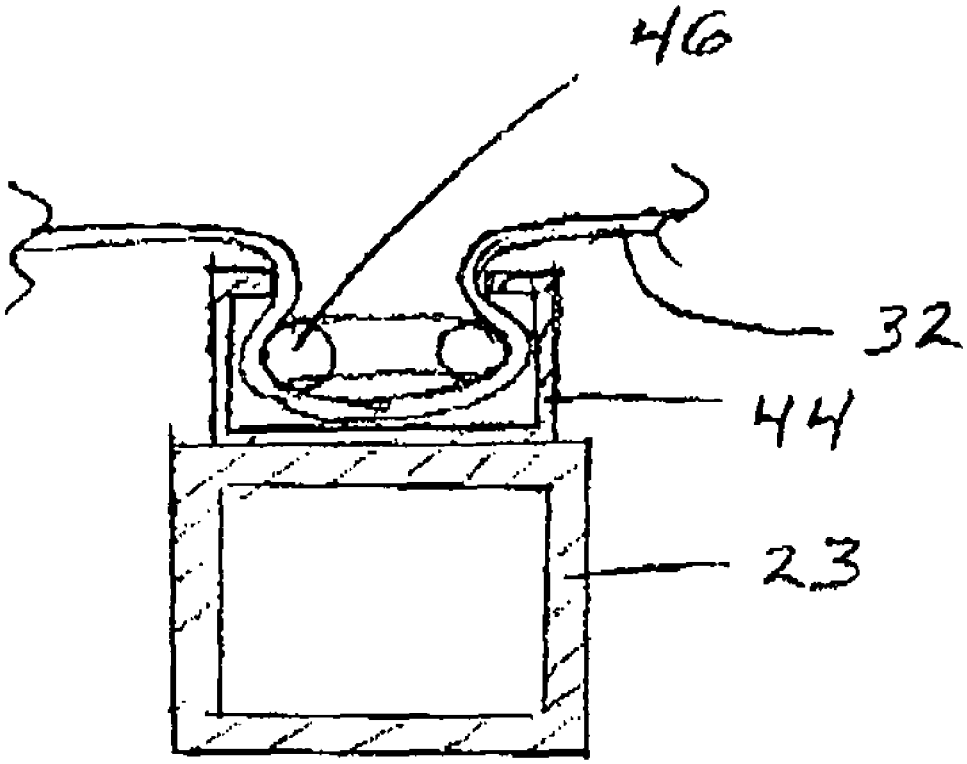
FIG. 2B is an enlarged cross sectional view of the frame leg taken along line 2B-2B in FIG. 2.

FIG. 2B is an enlarged cross sectional view of the frame leg taken along line 2B-2B in FIG. 2. FIG. 2B shows the canvas clamped between the C shaped channel portion of the frame leg and the zig-zagged wire positioned within the C shaped channel. In the most preferred embodiment the canvas 32 is adapted to cover an inner side of the frame 22, and the tent 20 further comprises canvas attachment means 42, for attachment of the canvas 32 thereto. Most preferably the frame comprises 22 a square tubing portion 23 and the canvas attachment means 42 comprises a C shaped channel portion 44, having a bark attached to an inner side of the square tubing portion 23, and an expansion means which most preferably is a zig-zagged wire 46 positioned in the C shaped channel 44 to clamp the canvas 32 between the C shaped channel and the zig-zagged wire 46. Most preferably the upper 26 and lower frame leg portions 28 are lockingly binged with lever clamps.

Figure 3:
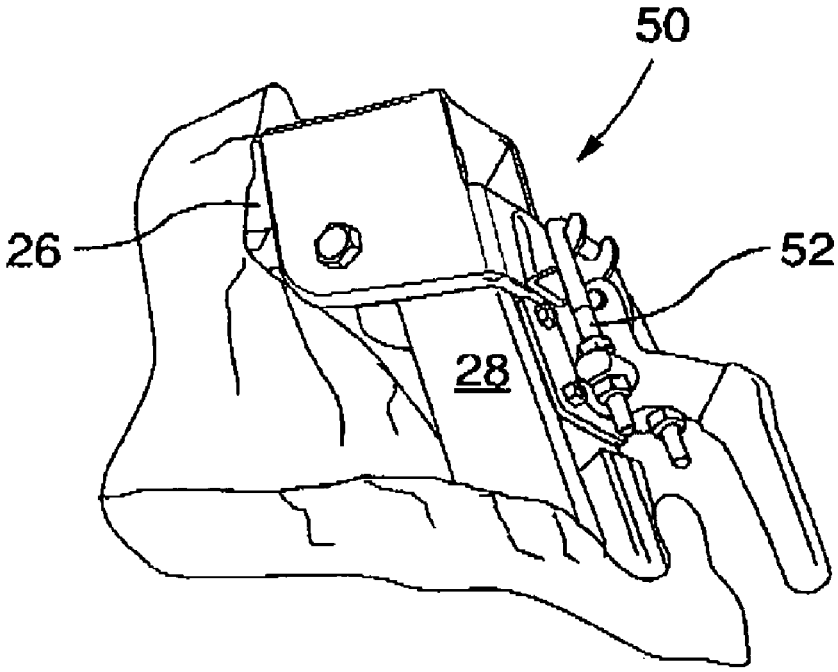
FIG. 3 is an enlarged perspective view of a locked top corner hinge used to hingably lock the upper and lower frame leg portions are lockingly with a lever clamp.

FIG. 3 is an enlarged perspective view of a locked top corner hinge 50 used to hingably lock the upper 26 and lower frame leg portions 28 are lockingly with a lever clamps 52. Lever clamps 52 are ideal to lock the upper 26 and lower 28 leg portions together. When the frame 22 is assembled, and comprises 2" aluminum tubing, with a span of 14' between the bottom portion of the legs 28, a weight of 500 pounds can be hung from the crown 30 quite safely. Referring back to FIG. 1 in the most preferred embodiment of the invention the tent frame legs 24 further comprise stakes 60 and ground plates 62 having stake openings 64 therethrough, said ground plates 62 attached to a bottom side portion of the lower portion of each leg 28, so that the legs 24 can be staked to the ground 66 for stability in high wind. Most preferably the canvas extends 32 along the ground so that sand bags or product stored (neither shown) in the tent 20 can be used to weight the bottom portion of the canvas 32 on the ground 66 and thereby prevent air entry.

Figure 4:
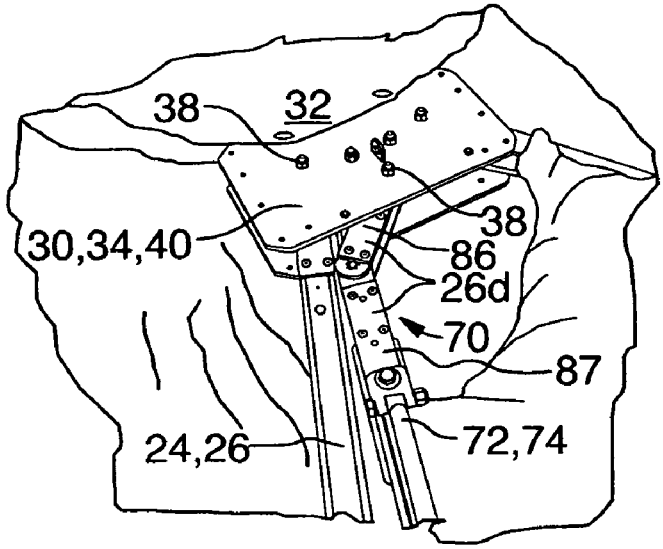
FIG. 4 shows the crown shown in FIG. 2 further comprising a door side leg which laterally swings between adjacent frame legs.

FIG. 4 shows the crown 30 shown in FIG. 2 further comprising a door side leg 70 which laterally swings between adjacent frame legs 24. In a preferred embodiment of the invention the tent further comprises a door side leg 70 for opening an entire segment of the tent between two tent frame legs 24 for convenient entry of large equipment, said door leg 70 rotably positioned between two spaced apart frame legs 24, wherein the door side leg can be rotated between an open position and a closed position adjacent to a frame leg 24 on one side of the door and wherein canvas 32 attached to the door side leg 70 is pulled and held in a closed position when the leg is rotated to the closed position. Most preferably the door side leg 70 comprises an upper portion 26D and a lower portion 28D lockably hinged together, and wherein an upper portion of the door side leg 26D comprises an elongate laterally swinging hinge link 86 having an inner end portion laterally hinged between a front side portion of the planar members 40 by a bolt 38 and an outer end portion laterally hinged to an intermediate portion of the door side leg 26D, said laterally swinging hinge link 86 and the outer end portion of the door side leg 70 having a combined length generally equal to the length of an upper portion of a frame leg 26, whereby the door side leg 70 is able to swing to a position longitudinally adjacent to the tent frame leg 24. As shown in FIG. 4 an inner upper portion of the door side leg 70 may be provided with a handle 72 which is pivotably attached thereto for movement of the door side leg to open and close a segment of the tent 20 for entry or removal of large materials or equipment (neither shown). The handle 72 shown in FIG. 4 comprises a long tube 74 which is releasably held (not shown) adjacent to the door leg 24. This long tube 74 is also useful in maintaining the crown 30 in an elevated position when erecting the tent 20.

Figure 5:
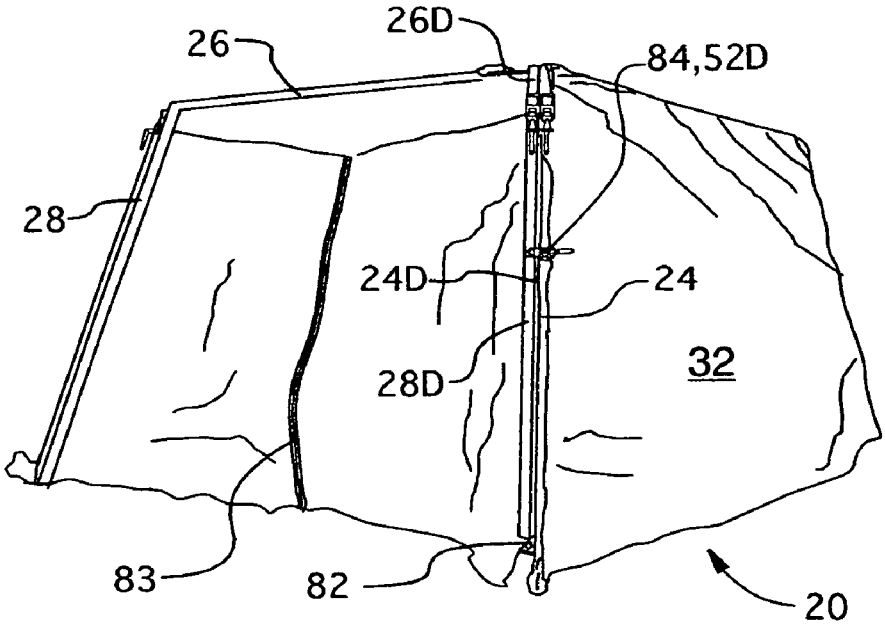
FIG. 5 shows a front view of the tent showing a lower door leg peg attached to a frame leg and a clamp to maintain the upper portion of the door leg against the frame leg.

FIG. 5 shows a front view of the tent 20 having a lower door leg peg 82 attached to a frame leg 24 and a clamp 52 to maintain the upper portion of the door leg 70 against the frame leg 24. In a preferred embodiment the lower portion of the door leg 28D is shorter than the lower portion of the frame leg 28, and further comprises an upright peg 82 non-removably attached to a lower portion 28 of the adjacent frame leg 24. The peg 82 receives the lower end portion 28D of the door leg 24D thereover. A door clamp means 84 maintains the door side leg 24D closely adjacent to frame side leg 24, thereby releasably holding the door leg 70 in a tightly closed position. Most preferably the door clamp means 84 comprises a lever clamp 52. A zippered door opening 83 allows an individual to enter the tent 20 rather than entering by unclamping and rotating the lower portion of the door frame leg 28D. Entry by rotating the door frame leg 28D is intended for convenient entry of large items (loaded on skids) and bulky equipment. When the lower portion of the door frame leg 28D is fully open a skid steer loaded can drive into the tent 20.

In the most preferred embodiment of the invention the frame 22 comprises aluminum, and a planar plastic bushing 87 (see FIG. 4) is attached to upper and lower sides of the legs 24, between the legs 24, 70 and planar members 40 to facilitate movement and prevent wear. The tent 20 has four frame legs 24, each having a lower portion 28 which is 7'10" high, so that the folded tent 20 can be carried in a pickup truck with a closed tailgate. The tent is 9' high.

A method of erecting a tent 20 comprises the following steps: providing a tent 20 as most generally described above; rotatably separating the hinged and adjacent upper and lower portions of the frame legs 24, and clamping the upper 26 and lower 28 legs 24 in the open position; and rotatably separating and spacing apart the open legs 24 whereby the tent frame 22 attains a standing position.

While the invention has been described with preferred specific embodiments thereof, it will be understood that this description is intended to illustrate and not to limit the scope of the invention, which is defined by the following claims.

We claim:

1. A tent comprising:

a frame having a) multiple frame legs, each leg having a lower portion lockingly hinged to an upper portion, wherein the lower portion can be swung open from a storage position in which the upper and lower portions are adjacent to each other, and then locked in an open operable position; and, b) a crown having two spaced apart parallel members to which an inner end portion of the upper portion of each one of the multiple legs is hinged generally laterally therebetween, the hinges including pivot pins attached to and extending between the parallel members and each pivot pin extends through an inner end portion of a different frame leg;

wherein the pivot pins are spaced sufficiently apart and along a central portion of the spaced apart parallel members, to permit a storage position wherein all of the legs extend outwardly from the spaced apart members in single direction, adjacent and parallel to each other, so that without removing the pivot pins from either the legs and the spaced apart parallel members, the legs rotate to an operable, spaced apart position in which the frame legs radiate outwardly from and around the crown;

said crown thereby facilitating a maximally small and compact storage position while providing a maximally secure operable position, as well as quick and convenient tent set up; and, a canvas, shaped to cover one of an inner and outer sides of the frame.

2. A tent as in claim 1 wherein the crown comprises the two spaced apart generally parallel members and the pivot pins comprise bolts extending between the parallel members and through the inner end portion of each of the frame legs.

3. A tent as in claim 2 wherein the two spaced apart parallel members comprise planar members attached together by spacers and wherein the hinge pins comprise bolts are spaced along a central portion of a length of the planar members.

4. A tent as in claim 3 further comprising a nonslidable canvas attachment means, for nonslidable attachment of the canvass along a length of the multiple frame legs, said canvass thereby providing substantial structural support for the frame.

5. A tent as in claim 4 wherein the frame comprises square tubing and the canvas attachment means comprises a C shaped channel, having a back attached to an inner side of the square tubing, and a zig-zagged wire positioned therein to clamp the canvas therebetween.

6. A tent as in claim 5 wherein the upper and lower frame leg portions are lockingly hinged with lever clamps.

7. A tent as in claim 5 further comprising stakes and ground plates having stake openings therethrough, said ground plates attached to a bottom side portion of the lower portion of each leg, so that the legs can be staked to the ground for stability in high wind.

8. A tent as in claim 3 further comprising a door side leg for opening an entire segment of the tent between two tent frame legs for convenient entry of large equipment, said door leg rotably positioned between two spaced apart frame legs, wherein the door side leg can be rotated between an open position and a closed position adjacent to a leg on one side of the door and wherein canvas attached to the door side leg is pulled and held in a closed position when the leg is rotated to the closed position.

9. A tent as in claim 8 wherein the door side leg comprises an upper portion and a lower portion lockably hinged together, and wherein an upper portion of the door side leg comprises an elongate laterally swinging hinge link having an inner end portion laterally hinged between a front side portion of the planar members by a bolt and an outer end portion laterally hinged to an intermediate portion of the door side leg, said laterally swinging hinge link and the outer end portion of the door side leg having a combined length generally equal to the length of an upper portion of a frame leg, whereby the door side leg is able to swing to a position longitudinally adjacent to the tent frame leg.

10. A tent as in claim 8 wherein the lower portion of the door leg is shorter than the lower portion of the frame leg, and wherein the tent further comprises an upright peg attached to a lower portion of the adjacent frame leg to which the door side leg is able to swing adjacent to, to receive the lower end portion of the door leg thereover, and further comprises a door clamp means to maintain an upper portion of the door side leg closely adjacent to frame side leg, thereby releasably holding the door leg in a tightly closed position.

11. A tent as in claim 10 wherein the door clamp means comprises a lever clamp.

12. A tent as in claim 9 wherein the frame comprises aluminum and wherein a planar plastic bushing is attached to upper and lower sides of the legs, between the legs and planar members to facilitate movement and prevent wear.

13. A method of erecting a tent comprises the following steps:

providing a tent as described in claim 1;

rotatably separating the hinged and adjacent upper and lower portions of the frame legs, and clamping the upper and lower legs in the open position; and, rotatably separating and spacing apart the legs whereby the tent frame attains a standing position.

* * * * *